US010650956B2

(12) United States Patent
Yoshida et al.

(10) Patent No.: US 10,650,956 B2
(45) Date of Patent: May 12, 2020

(54) REACTOR HAVING IRON CORES AND COILS

(71) Applicant: FANUC CORPORATION, Yamanashi (JP)

(72) Inventors: Tomokazu Yoshida, Yamanashi (JP); Masatomo Shirouzu, Yamanashi (JP); Kenichi Tsukada, Yamanashi (JP)

(73) Assignee: FANUC CORPORATION, Yamanashi (JP)

( * ) Notice: Subject to any disclaimer, the term of this patent is extended or adjusted under 35 U.S.C. 154(b) by 0 days.

(21) Appl. No.: 16/000,517

(22) Filed: Jun. 5, 2018

(65) Prior Publication Data

US 2018/0366252 A1 Dec. 20, 2018

(30) Foreign Application Priority Data

Jun. 16, 2017 (JP) ..... 2017-118519
Jul. 12, 2017 (JP) ..... 2017-136303

(51) Int. Cl.

| | |
|---|---|
| ***H01F 27/26*** | (2006.01) |
| ***H01F 3/14*** | (2006.01) |
| ***H01F 27/32*** | (2006.01) |
| ***H01F 37/00*** | (2006.01) |

(52) U.S. Cl.

CPC ..... *H01F 27/26* (2013.01); *H01F 3/14* (2013.01); *H01F 27/263* (2013.01); *H01F 27/324* (2013.01); *H01F 37/00* (2013.01)

(58) Field of Classification Search

CPC ..... H01F 27/26; H01F 3/14; H01F 27/324; H01F 37/00

USPC ..... 336/5, 55, 170, 179, 178, 198

See application file for complete search history.

(56) References Cited

U.S. PATENT DOCUMENTS

| | | | | |
|---|---|---|---|---|
| 2,406,704 A * | 8/1946 | Mossay | H01F 30/12 336/5 | |
| 2009/0261939 A1* | 10/2009 | Shudarek | H01F 3/10 336/212 | |
| 2013/0187741 A1* | 7/2013 | Goodrich | H01F 3/10 336/170 | |
| 2018/0268992 A1 | 9/2018 | Tsukada et al. | | |

FOREIGN PATENT DOCUMENTS

| | | | | |
|---|---|---|---|---|
| CN | 201122492 Y | 9/2008 | | |
| CN | 201765902 U | 3/2011 | | |
| CN | 102568765 A | 7/2012 | | |
| CN | 102856047 A | 1/2013 | | |
| CN | 208507391 U | 2/2019 | | |
| FR | 1344403 A | 11/1963 | | |
| GB | 1415209 A * | 11/1975 | | H01F 27/02 |
| JP | S49043123 A | 4/1974 | | |
| JP | 2000012345 A * | 1/2000 | | |

(Continued)

*Primary Examiner* — Tszfung J Chan
(74) *Attorney, Agent, or Firm* — RatnerPrestia

(57) ABSTRACT

A core body of a reactor includes an outer peripheral iron core composed of a plurality of outer peripheral iron core portions, at least three iron cores coupled to the plurality of outer peripheral iron core portions, and coils wound onto the at least three iron cores. Gaps, which can be magnetically coupled, are formed between one of the at least three iron cores and another iron core adjacent thereto. The reactor includes cover parts which at least partially cover the iron cores and provide insulation from the coils.

6 Claims, 14 Drawing Sheets

(56) References Cited

FOREIGN PATENT DOCUMENTS

| | | | |
|---|---|---|---|
| JP | 2000-077242 | A | 3/2000 |
| JP | 2008-210998 | A | 9/2008 |
| JP | 2017059805 | A | 3/2017 |
| JP | 2018157094 | A | 10/2018 |

* cited by examiner

REACTOR HAVING IRON CORES AND COILS

CROSS-REFERENCE TO RELATED APPLICATIONS

This application is a new U.S. Patent Application that claims benefit of Japanese Patent Application No. 2017-118519, filed Jun. 16, 2017 and Japanese Patent Application No. 2017-136303, filed Jul. 12, 2017, the disclosures of these applications are being incorporated herein by reference in their entirety for all purposes.

BACKGROUND OF THE INVENTION

1. Field of the Invention

The present invention relates to a reactor having iron cores and coils.

2. Description of Related Art

Reactors include a plurality of iron core coils, and each iron core coil includes an iron core and a coil wound onto the iron core. Predetermined gaps are formed between the plurality of iron cores. Refer to, for example, Japanese Unexamined Patent Publication (Kokai) No. 2000-77242 and Japanese Unexamined Patent Publication (Kokai) No. 2008-210998.

There are reactors in which a plurality of iron cores and coils wound onto the iron cores are arranged inside an outer peripheral iron core composed of a plurality of outer peripheral iron core portions. In such reactors, the iron cores are integrally formed with the respective outer peripheral iron core portions. The predetermined gaps are formed between the adjacent iron cores in the center of the reactor.

SUMMARY OF THE INVENTION

In such reactors, the coils are attached to the iron cores in a state in which the coils are housed within casings. Thus, the heat generated from the coils when the reactor is supplied with electricity can easily accumulate within the casing. As a result, there is a problem in that the temperature of the coils rises rapidly, and the temperature of the reactor is likely to rise as well.

Further, since the casing is composed of a plurality of parts, there is a problem in that the number of parts of the casing increases as the number of coils increases.

Thus, a reactor which does not rise in temperature easily is desired.

According to a first aspect of the present disclosure, there is provided a reactor comprising a core body, the core body comprising an outer peripheral iron core composed of a plurality of outer peripheral iron core portions, at least three iron cores coupled to the plurality of outer peripheral iron core portions, and coils wound onto the at least three iron cores, wherein gaps, which are magnetically coupled, are formed between one of the at least three iron cores and another iron core adjacent thereto, the reactor further comprising cover parts which at least partially cover the iron cores and provide insulation from the coils.

In the first aspect, the coils are not housed in casings, and the coils are attached to the iron cores in an exposed state via the cover parts. Thus, when the reactor is supplied with electricity, the heat from the coils can be released to the outside, and as a result, a rise in temperature of the reactor can be prevented.

The object, features, and advantages of the present invention, as well as other objects, features and advantages, will be further clarified by the detailed description of the representative embodiments of the present invention shown in the accompanying drawings.

DETAILED DESCRIPTION

Figure 1A:
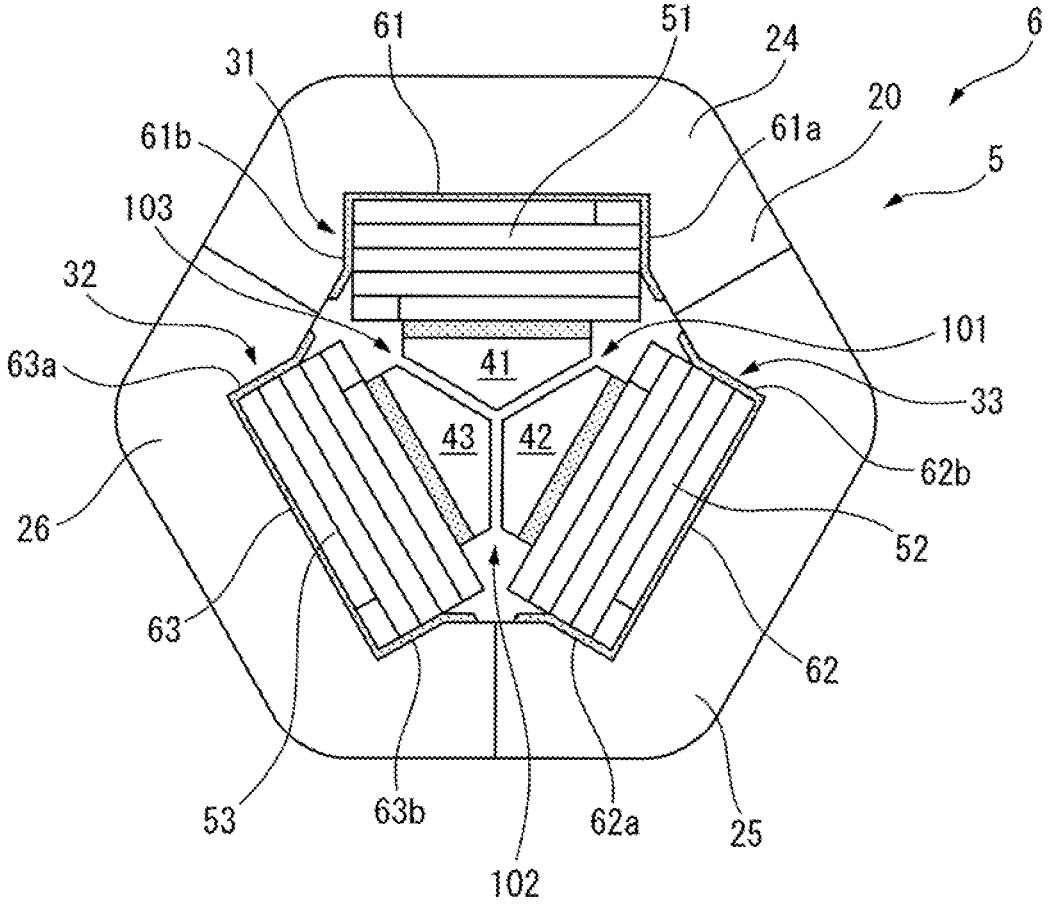
FIG. 1A is an end view of a reactor according to a first embodiment.

The embodiments of the present invention will be described below with reference to the accompanying drawings. In the following drawings, the same components are given the same reference numerals. For ease of understanding, the scales of the drawings have been appropriately modified.

In the following description, a three-phase reactor will mainly be described as an example. However, the present disclosure is not limited in application to a three-phase reactor, but can be broadly applied to any multiphase reactor requiring constant inductance in each phase. Further, the reactor according to the present disclosure is not limited to those provided on the primary side or secondary side of the inverters of industrial robots or machine tools, but can be applied to various machines.

Figure 1B:
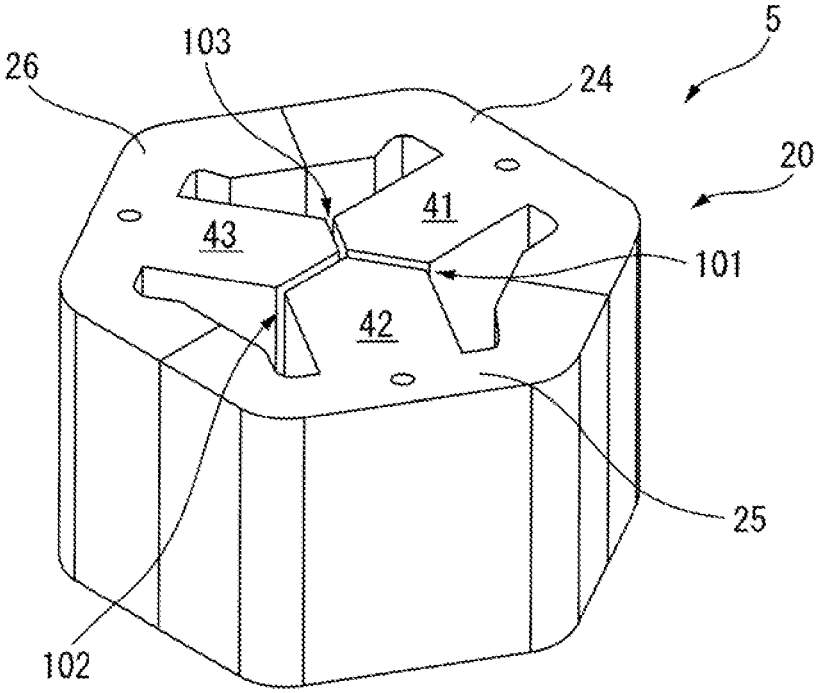
FIG. 1B is a partial perspective view of the reactor shown in FIG. 1A.

FIG. 1A is an end view of the reactor according to the first embodiment and FIG. 1B is a partial perspective view of the reactor shown in FIG. 1A. As shown in FIG. 1A and FIG. 1B, a core body 5 of a reactor 6 includes an annular outer peripheral iron core 20 and at least three iron core coils 31 to 33 arranged inside the outer peripheral core 20 at equal intervals in the circumferential direction thereof. Furthermore, it is preferable that the number of the iron cores be a multiple of three, whereby the reactor 6 can be used as a three-phase reactor. Note that the outer peripheral iron core 20 may have another shape, such as a circular shape. The iron core coils 31 to 33 include iron cores 41 to 43 and coils 51 to 53 wound onto the iron cores 41 to 43, respectively.

The outer peripheral iron core 20 is composed of a plurality of, for example, three, outer peripheral iron core portions 24 to 26 divided in the circumferential direction. The outer peripheral iron core portions 24 to 26 are formed integrally with the iron cores 41 to 43, respectively. The outer peripheral iron core portions 24 to 26 and the iron cores 41 to 43 are formed by stacking a plurality of iron plates, carbon steel plates, or electromagnetic steel sheets, or are formed from a dust core. When the outer peripheral iron core 20 is formed from a plurality of outer peripheral iron core portions 24 to 26, even if the outer peripheral iron core 20 is large, such an outer peripheral iron core 20 can be easily manufactured. Note that the number of iron cores 41 to 43 and the number of iron core portions 24 to 26 need not necessarily be the same.

As can be understood from FIG. 1A, the iron cores 41 to 43 are approximately the same size and are arranged at approximately equal intervals in the circumferential direction of the outer peripheral iron core 20. In FIG. 1A, the radially outer ends of the iron cores 41 to 43 are coupled to the outer peripheral iron core 20.

Further, the radially inner ends of the iron cores 41 to 43 converge toward the center of the outer peripheral iron core 20, and the tip angles thereof are approximately 120 degrees. The radially inner ends of the iron cores 41 to 43 are separated from each other via gaps 101 to 103, which can be magnetically coupled.

In other words, in the first embodiment, the radially inner end of the iron core 41 is separated from the radially inner ends of the two adjacent iron cores 42 and 43 via gaps 101 and 103. The same is true for the other iron cores 42 and 43. It is ideal that the sizes of the gaps 101 to 103 be equal to each other, but they may not be equal. As can be understood from FIG. 1A, the point of intersection of the gaps 101 to 103 is located at the center of the core body 5. The core body 5 is formed with rotation symmetry about this center.

In the first embodiment, the iron core coils 31 to 33 are arranged inside the outer peripheral iron core 20. In other words, the iron core coils 31 to 33 are surrounded by the outer peripheral iron core 20. Thus, leakage of magnetic flux from the coils 51 to 53 to the outside of the outer peripheral iron core 20 can be reduced.

Referring again to FIG. 1A, cover parts 61 to 63, which are formed from an insulating material, are arranged between the outer peripheral iron core portions 24 to 26 and the coils 51 to 53, respectively. The cover parts 61 to 63 at least partially cover the respective iron cores 41 to 43 and serve as insulators that provide insulation from the coils 51 to 53.

Figure 2A:
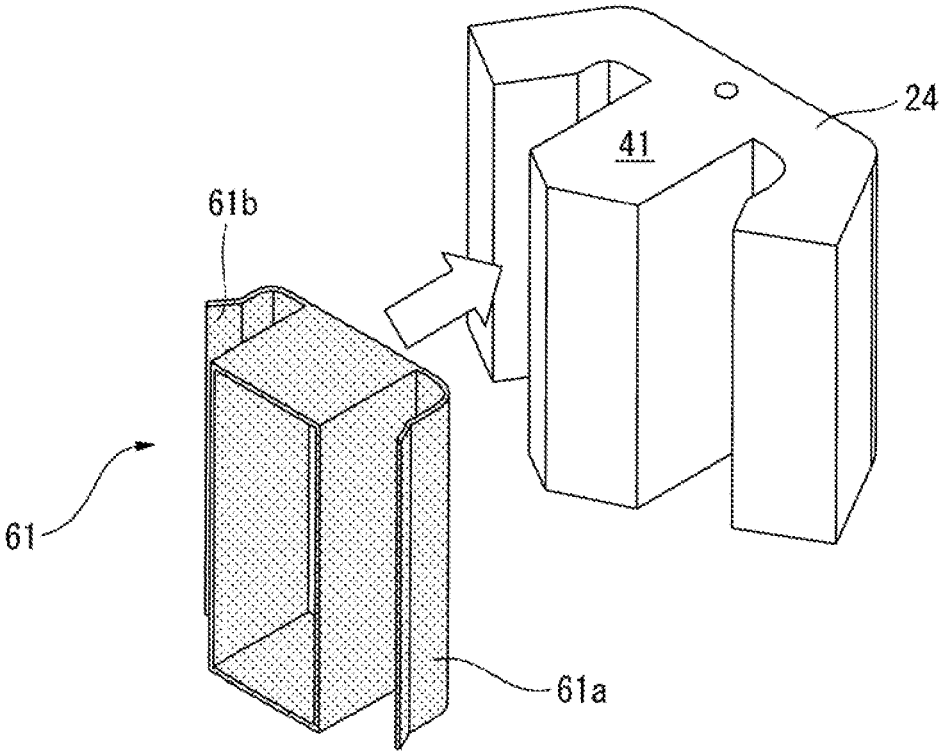
FIG. 2A is a first perspective view showing the manufacturing process of the reactor shown in FIG. 1A.
Figure 2B:
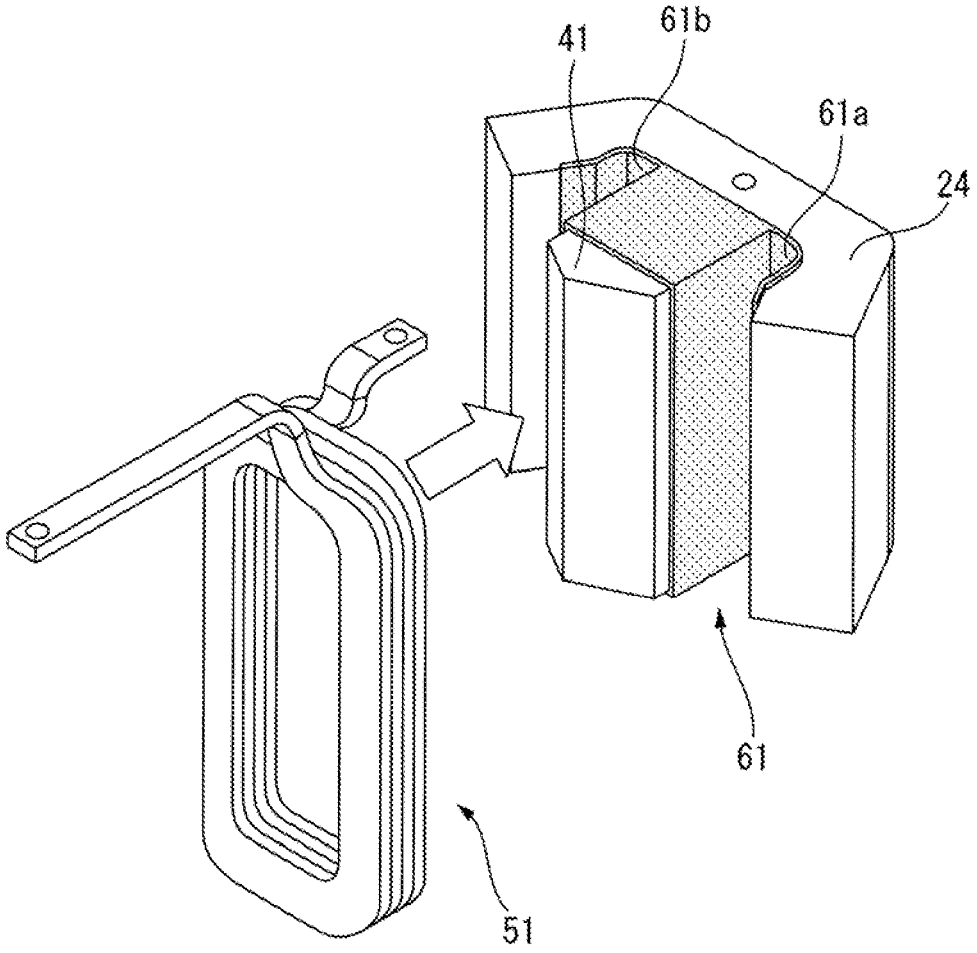
FIG. 2B is a second perspective view showing the manufacturing process of the reactor shown in FIG. 1A.
Figure 2C:
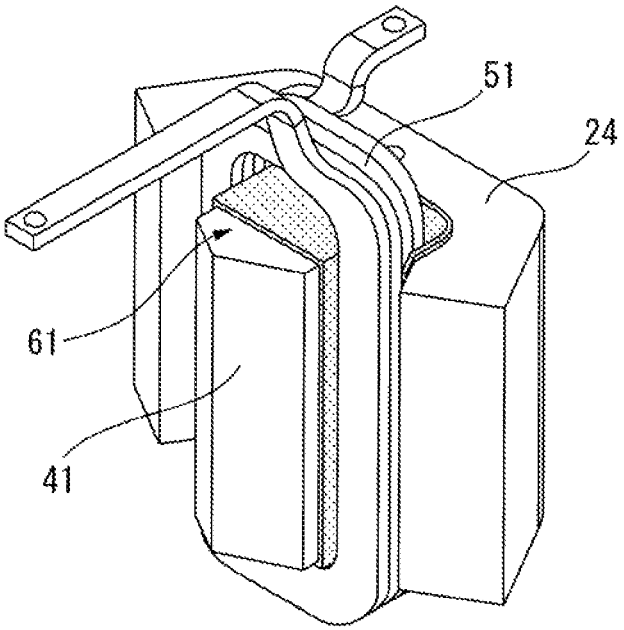
FIG. 2C is a third perspective view showing the manufacturing process of the reactor shown in FIG. 1A.

FIG. 2A through FIG. 2C are perspective views showing the manufacturing process of the reactor shown in FIG. 1A. Below, the installation of the coil 51 on the iron core 41, which is formed integrally with the outer peripheral iron core portion 24, will be described. Since the same is substantially true for the other iron cores 42 and 43, descriptions thereof have been omitted.

The cover part 61 is a tubular member having a rectangular cross-section and is made of an insulating material, for example, an insulating paper or a resin material. Further, additional cover parts 61*a* and 61*b* are attached to one edge portion of both side surfaces of the cover part 61. The additional cover parts 61*a* and 61*b* serve to at least partially cover the inner surface of the outer peripheral iron core portion 24 to provide insulation for the same from the coil 51. To this end, the additional cover parts 61*a* and 61*b* have shapes corresponding to the inner surface of the outer peripheral iron core portion 24. For this purpose, the additional cover parts 61*a* and 61*b* are preferably formed from a flexible insulating material, for example, an insulating paper.

As indicated by the arrow in FIG. 2A, the tubular cover part 61 is moved toward the iron core 41, whereby the iron core 41 is inserted into the cover part 61. As shown in FIG. 4B, the thickness of the cover part 61 is relatively small. As shown in FIGS. 2B and 2C, the exposed coil 51, which is not housed in a casing, is then moved toward the iron core 41, whereby the iron core 41 and the cover part 61 are inserted into the coil 51. The cover parts 62 and 63 are similarly attached to the other iron cores 42 and 43 formed integrally with the other outer peripheral iron core portions 25 and 26, and the exposed coils 52 and 53 are similarly attached. Thereafter, the iron cores 41 to 43 are assembled as shown in FIG. 1A, whereby the reactor 6 is manufactured.

Figure 3A:
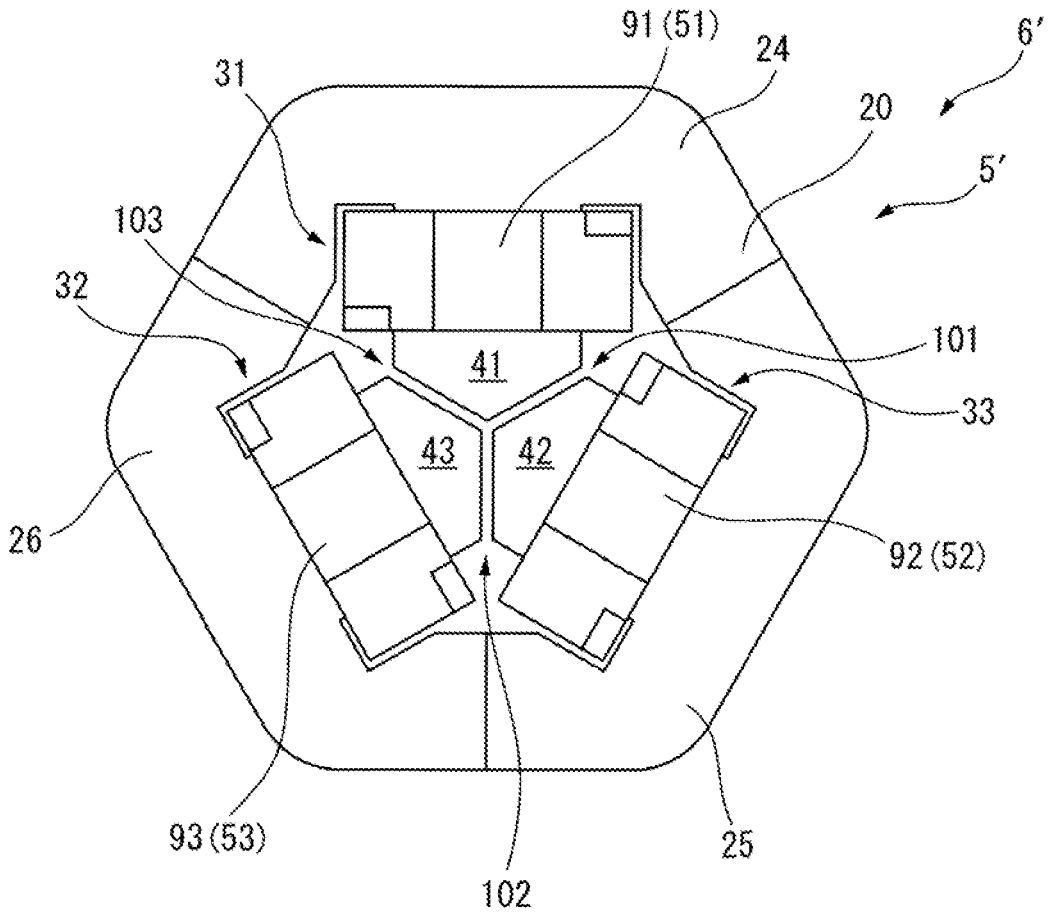
FIG. 3A is an end view of another reactor.

FIG. 3A is an end view of the core body of another reactor. The core body 5' of the reactor 6' has a configuration substantially the same as the core body 5 detailed with reference to FIG. 1A. In FIG. 3A, casings 91 to 93 are attached to iron cores 41 to 43, respectively, and coils 51 to 53 are housed in the casings 91 to 93, respectively. The casing 91 is composed of two half-molded portions 91*a* and 91*b* and a lid portion 91*c*. The same is true for the other casings 92 and 93.

Figure 3B:
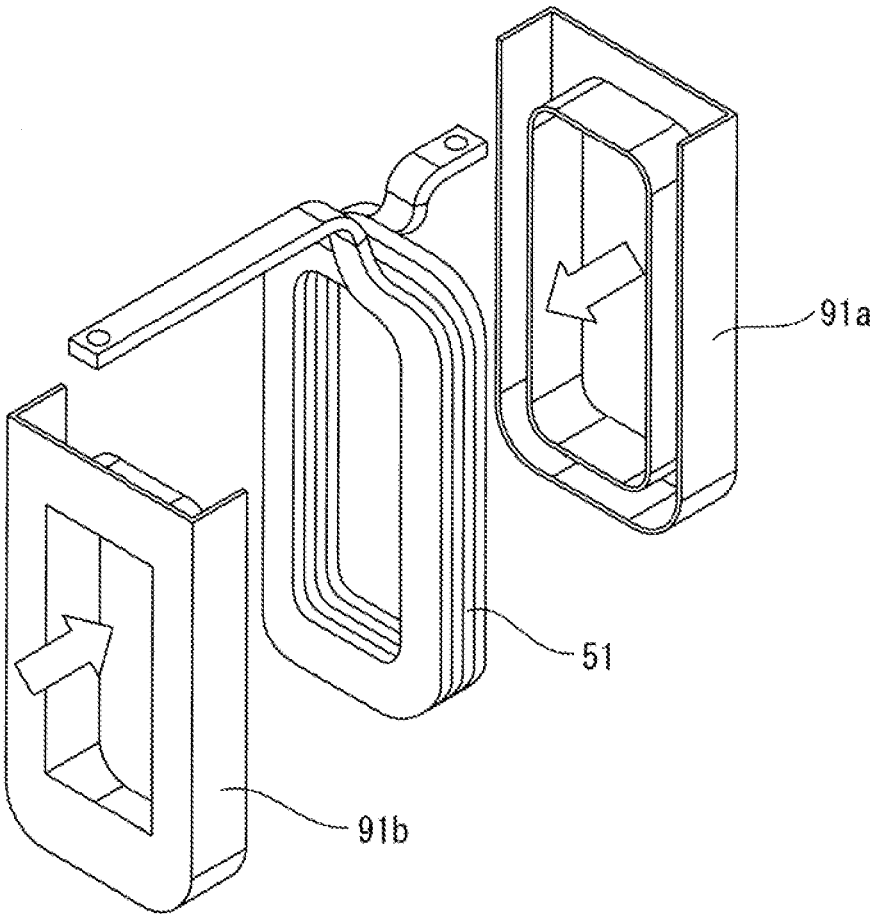
FIG. 3B is a first perspective view showing the manufacturing process of the reactor shown in FIG. 3A.
Figure 3C:
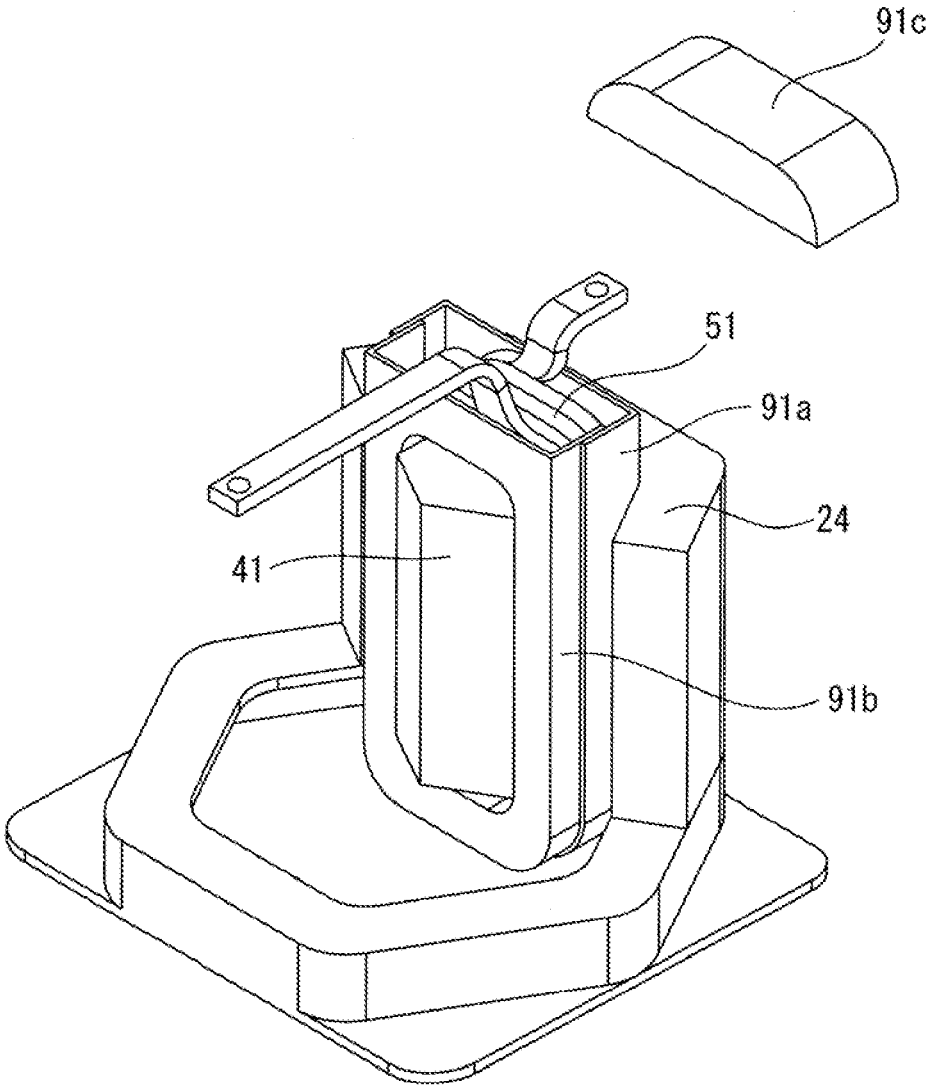
FIG. 3C is a second perspective view showing the manufacturing process of the reactor shown in FIG. 3A.

Further, FIG. 3B and FIG. 3C are perspective views showing the manufacturing process of the reactor shown in FIG. 3A. As shown in FIG. 3B, the two half-molded portions 91*a* and 91*b* of the casing 91 are attached to the axial ends of the coil 51. Then, as shown in FIG. 3C, the lid 91*c* is attached, whereby the coil 51 is housed within the casing 91. Thereafter, the casing 91 is attached to the iron core 41 in the same manner as described above. The iron cores 41 to 43 are then assembled as shown in FIG. 3A, whereby the reactor 6' is manufactured. In the case of the reactor 6' manufactured in this way, there is a problem in that the heat of the coils 51 to 53 tends to accumulate in the casings 91 to 93 when the reactor 6' is supplied with electricity.

In connection thereto, in the first embodiment, the coils 51 to 53 are not housed in the casings 91 to 93, but are attached to the iron cores 41 to 43 by means of the cover parts 61 to 63 in an exposed state. Thus, when the reactor 6 is energized, the heat from the coils 51 to 53 is released to the outside, and as a result, a rise in temperature of the reactor 6 can be prevented. Further, since only one cover part 61 is necessary for one coil 51, even when the number of coils is increased, the number of parts does not increase significantly.

The additional cover parts 61*a* and 61*b* of the cover part 61 described above have shapes corresponding to the inner surface of the outer peripheral iron core portion 24. Thus, when the cover part 61 is attached to the iron core 41, as shown in FIG. 2B, the additional cover parts 61*a* and 61*b* partially cover the inner surface of the outer peripheral iron core portion 24. By use of the additional cover parts 61*a* and 61*b*, contact between the end surface of the coil 51 and the inner surface of the outer peripheral iron core portion 24 can be prevented. Thus, it is not always necessary to form a clearance between the coil 51 and the additional cover parts 61*a* and 61*b*. The same is true for the additional cover parts 62*a* and 62*b* of the other cover part 62 and the additional cover parts 63*a* and 63*b* of the other cover part 63. Thus, when the additional cover parts 61*a* to 63*b* are provided, the reactor 6 can be miniaturized.

Figure 4A:
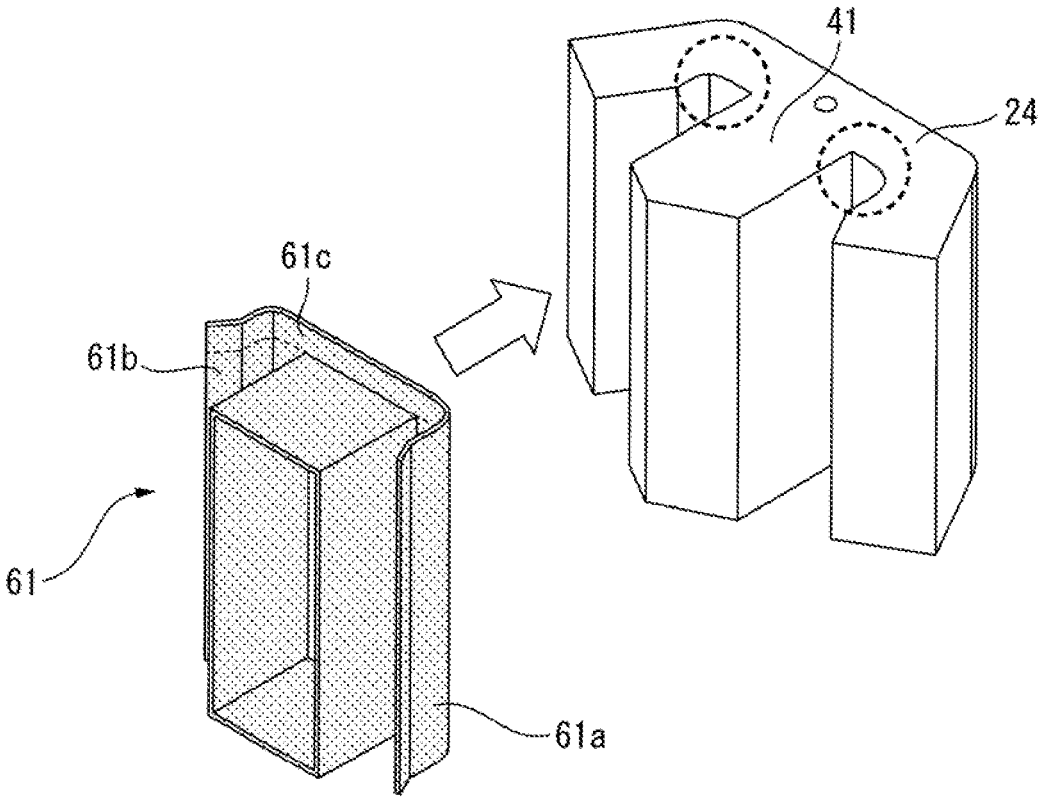
FIG. 4A is a first perspective view showing the manufacturing process of a reactor according to a second embodiment.
Figure 4B:
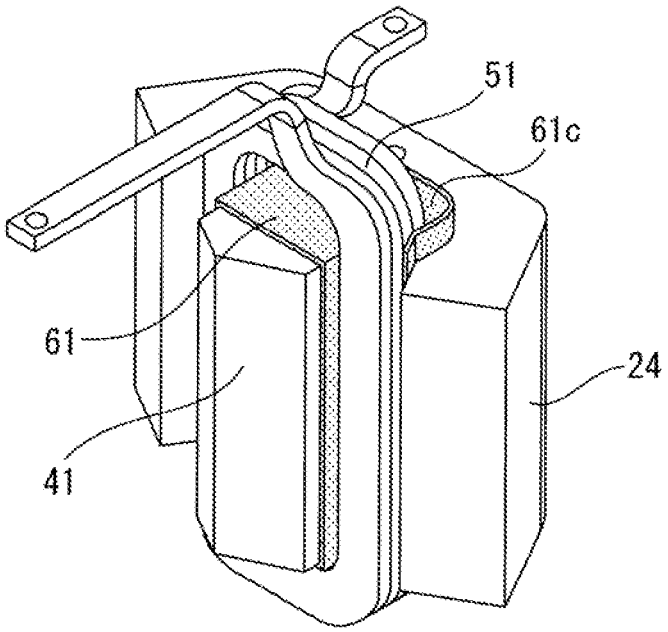
FIG. 4B is a second perspective view showing the manufacturing process of the reactor according to the second embodiment.

Further, FIG. 4A and FIG. 4B are perspective views showing the manufacturing process of the reactor according to the second embodiment. The cover part 61 shown in FIG. 4A includes a projecting portion 61*c* projecting from one end surface of the iron core 41. The projecting portion 61*c* shown in FIG. 4A includes portions extending from the additional cover parts 61*a* and 61*b* and a portion projecting from the cover part 61 as a tubular member. However, the projecting portion 61*c* may include at least one of the portions extending from the additional cover parts 61*a* and 61*b* and the portion projecting from the cover part 61 as a tubular member. Furthermore, the cover part 61 may include another projecting portion 61*c* projecting from the other end face of the iron core 41.

When the cover part 61 having such a projecting portion 61*c* is used, the projecting portion 61*c* projects upward from the end surfaces of the iron core 41 and the outer peripheral iron core portion 24, as shown in FIG. 4B. As a result, the insulation between the inner surface of the adjacent peripheral iron core portion 24 and the coil 51 can be further improved.

Furthermore, the core body 5 is not limited to the configuration shown in FIG. 1A. Another configuration of the core body 5 in which the plurality of iron core coils are surrounded by the outer peripheral iron core 20 is included within the scope of the present disclosure.

Figure 5:
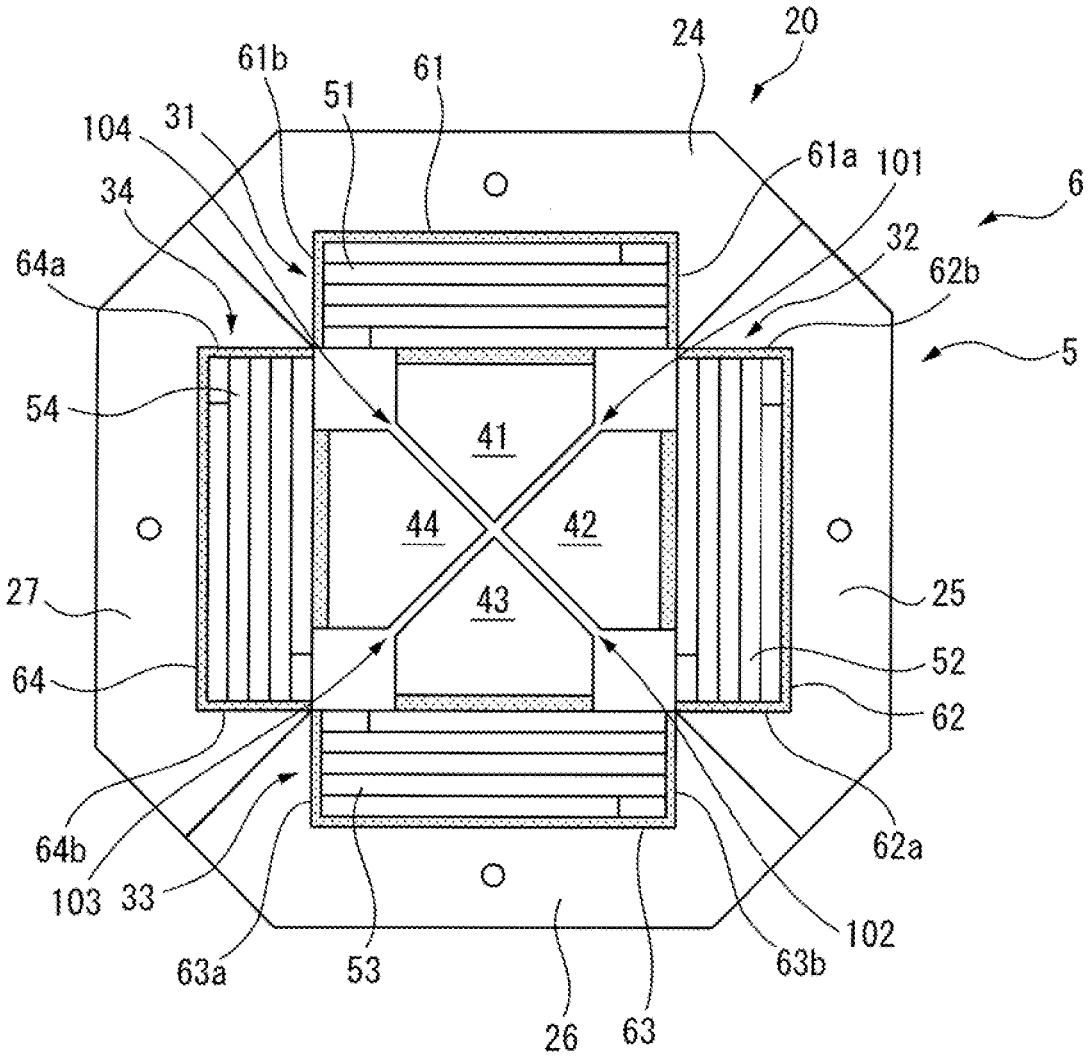
FIG. 5 is an end view of a reactor according to a third embodiment.

FIG. 5 is a cross-sectional view of the reactor 6 of a third embodiment. The core body 5 of the reactor 6 shown in FIG. 5 includes an approximately octagonal outer peripheral iron core 20 and four iron core coils 31 to 34, which are the same as the aforementioned iron core coils, and which are in contact with the inner surface of the outer peripheral iron core 20 or are attached to the outer peripheral iron core 20. These iron core coils 31 to 34 are arranged at substantially equal intervals in the circumferential direction of the reactor 6. Furthermore, the number of the iron cores is preferably an even number of 4 or more, so that the reactor 6 can be used as a single-phase reactor.

As can be understood from the drawing, the iron core coils 31 to 34 include iron cores 41 to 44 extending in the radial direction and coils 51 to 54 wound onto the respective iron cores, respectively. The radially outer ends of the iron cores 41 to 44 are in contact with the outer peripheral iron core 20 or are integrally formed with the outer peripheral iron core 20.

Further, each of the radially inner ends of the iron cores 41 to 44 is located near the center of the outer peripheral iron core 20. In FIG. 5, the radially inner ends of the iron cores 41 to 44 converge toward the center of the outer peripheral iron core 20, and the tip angles thereof are about 90 degrees. The radially inner ends of the iron cores 41 to 44 are separated from each other via the gaps 101 to 104, which can be magnetically coupled.

In the third embodiment, the coils 51 to 54 are attached to the iron cores 41 to 44 via the cover parts 61 to 64 in the same manner as described above. The cover parts 61 to 64 include additional cover parts 61*a* to 64*b*, respectively, similar to those described above. Thus, it can be understood that the same effects as described above can be obtained. Note that the additional cover parts 61*a* to 64*b* preferably have areas which are large enough to cover the side surfaces of the respective coils. Furthermore, the cover parts 61 to 64 may be provided with projecting portions 61*c* to 64*d*, similar to those described above.

Figure 6A:
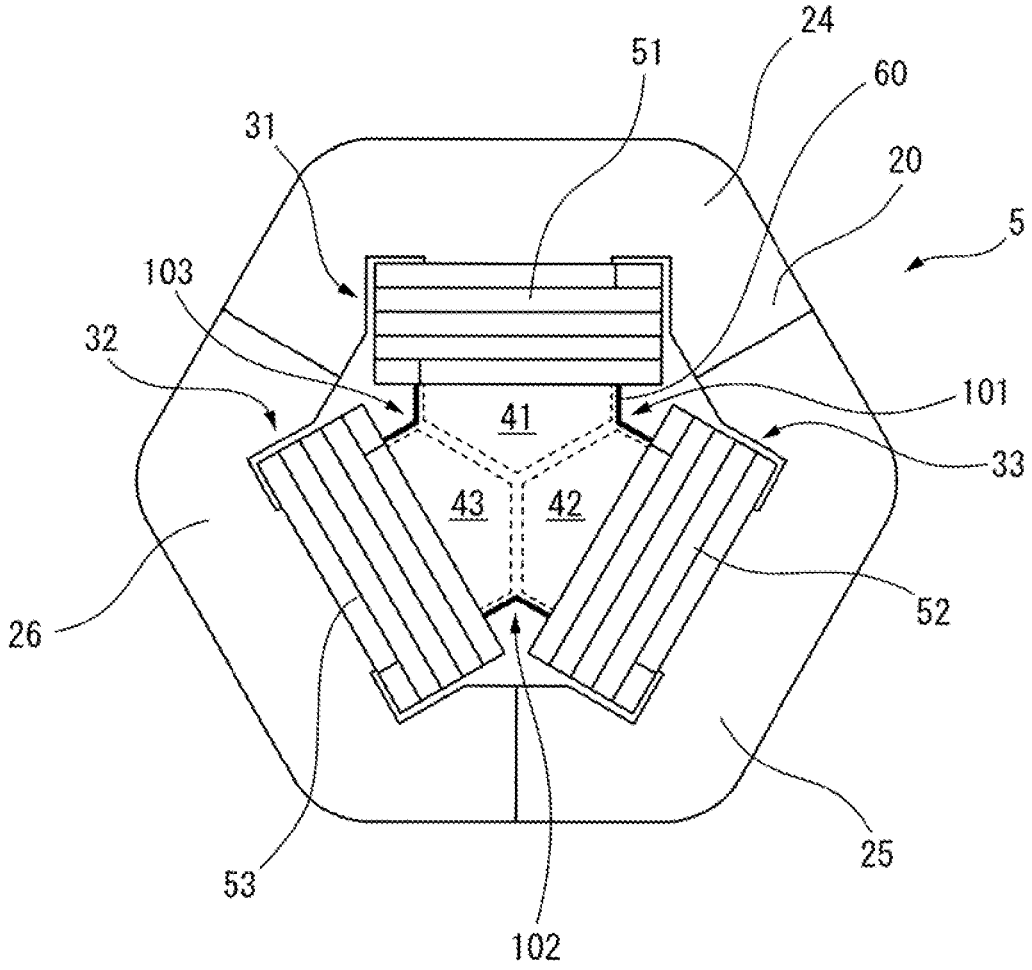
FIG. 6A is an end view of a reactor according to a fourth embodiment.
Figure 6B:
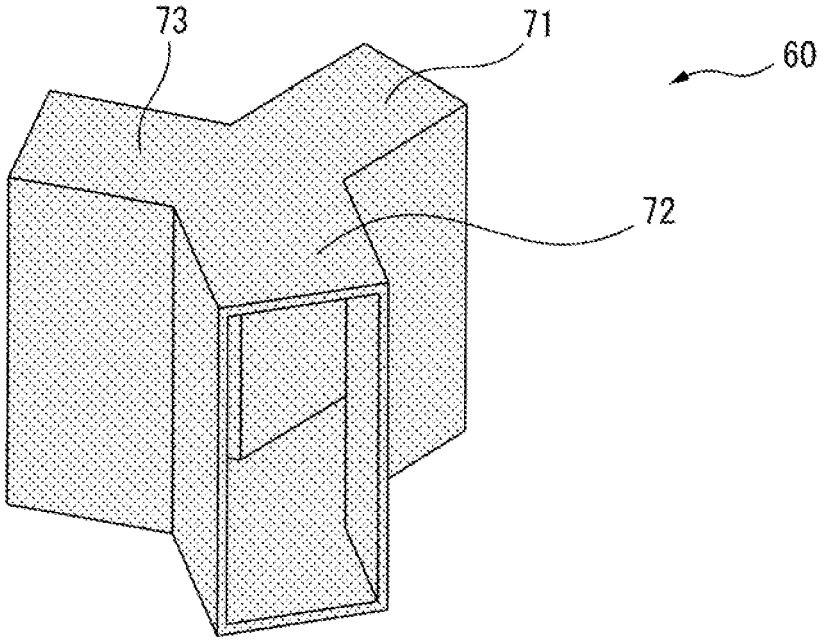
FIG. 6B is a perspective view of a cover part used in the reactor shown in FIG. 6A.

FIG. 6A is an end view of the reactor according to the fourth embodiment, and FIG. 6B is a perspective view of a cover part used in the reactor shown in FIG. 6A. As can be understood from these drawings, the cover part 60 of the fourth embodiment is a substantially Y-shaped single member having three tubular parts 71 to 73 spaced at equal intervals in the circumferential direction. The cover part 60 is made of an insulating material, for example, an insulating paper or a resin material. When the tubular parts 71 to 73 of the cover part 60 are attached to the iron cores 41 to 43, respectively, the cover part 60 covers the iron cores 41 to 43 as a whole and provides insulation from the coils 51 to 53. As can be seen from FIG. 6A, the radially inner ends of the iron cores 41 to 43 and the gaps 101 to 103 are not exposed and are covered by the cover part 60.

Figure 6C:
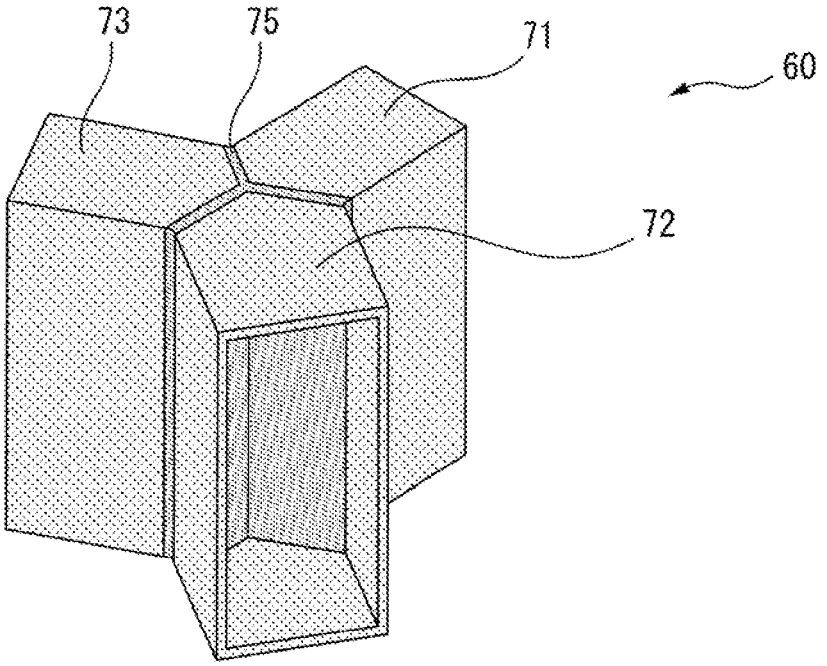
FIG. 6C is a perspective view of another cover part.

FIG. 6C is a perspective view of another cover part. The tubular parts 71 to 73 of the other cover part 60 shown in FIG. 6C have shapes generally corresponding to the iron cores 41 to 43, respectively. The tubular parts 71 to 73 are isolated from each other by a partition 75. The partition 75 has a substantially Y shape corresponding to gaps 101 to 103. The partition 75 is preferably formed of a nonmagnetic material or an insulating material, similar to cover part 60.

When the other cover part 60 shown in FIG. 6C is attached, the partition 75 is arranged in contact with the gaps 101 to 103. Thus, the dimensions of the gaps 101 to 103 can be maintained by the partition 75. Thus, even when the reactor 6 is energized, the iron cores 41 to 43 do not vibrate, whereby noise from the reactor 6 and the vibration of the reactor 6 can be prevented.

Figure 7A:
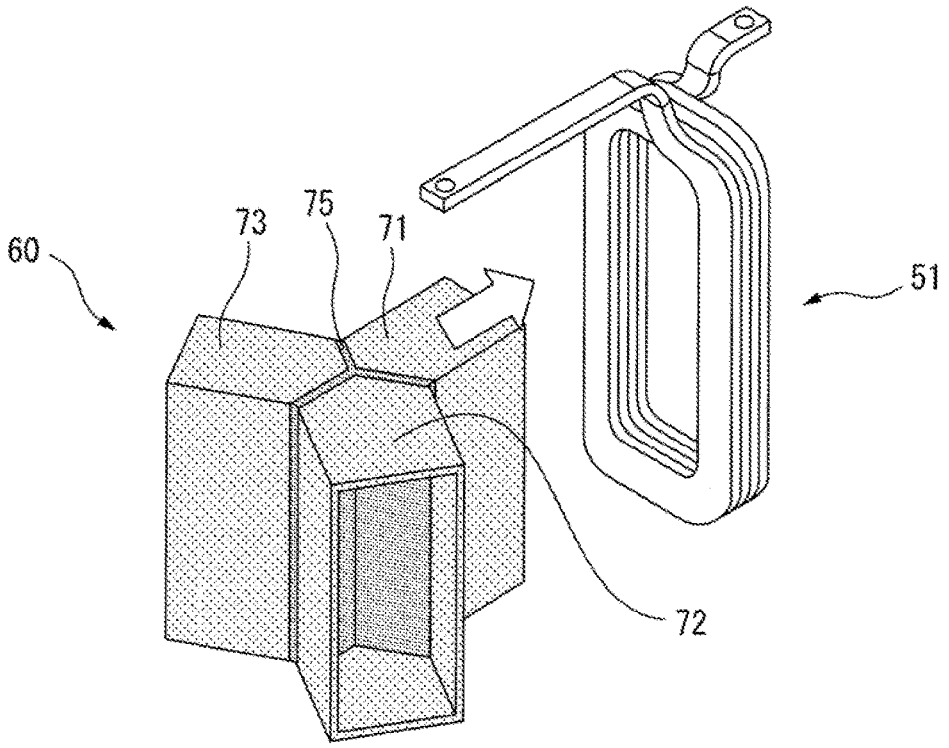
FIG. 7A is a first perspective view showing the manufacturing process of the reactor according to the fourth embodiment.
Figure 7B:
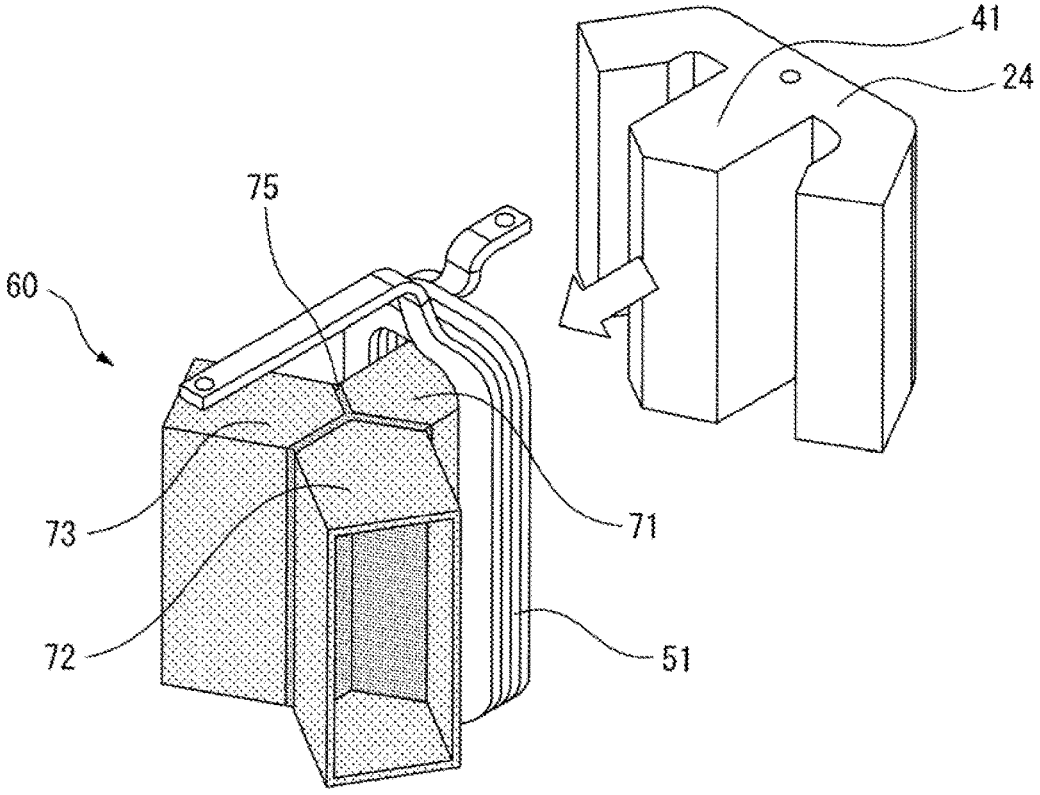
FIG. 7B is a second perspective view showing the manufacturing process of the reactor according to the fourth embodiment.
Figure 7C:
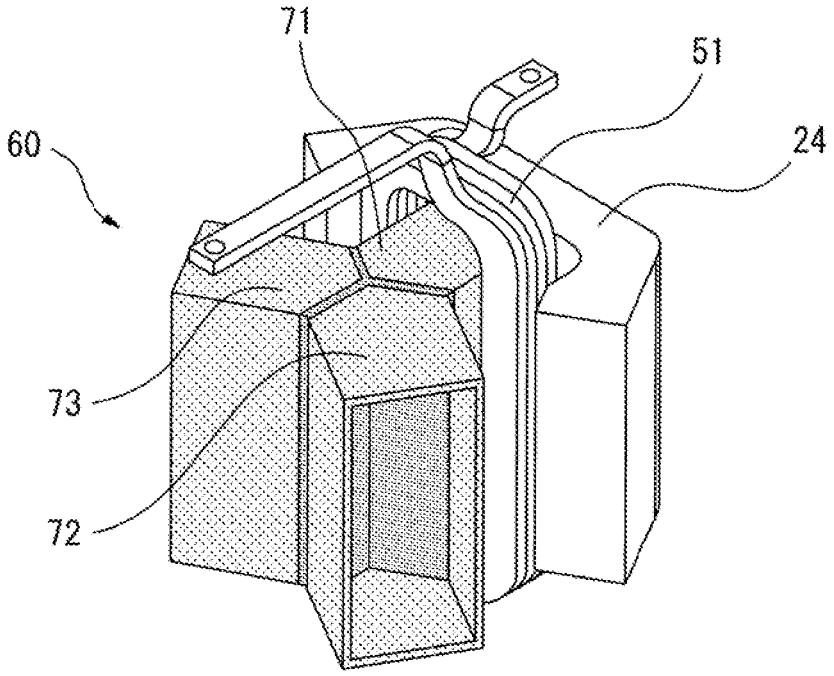
FIG. 7C is a third perspective view showing the manufacturing process of the reactor according to the fourth embodiment.

FIG. 7A through FIG. 7C are perspective views of the manufacturing process of the reactor according to the fourth embodiment. Below, the installation of the cover part 60 including the partition 75 onto the iron core 41 to 43 will be described, which is substantially the same as the case of the cover part 60 having no partition 75.

First, as shown in FIG. 7A, the cover part 60 is moved toward the coil 51, whereby the tubular part 71 of the cover part 60 is inserted into the coil 51. As described above, the coil 51 (and the other coils 52 and 53) is in an exposed state and is not housed in the casing. As shown in FIG. 7B and FIG. 7C, the iron core 41, which is integrally formed with the outer peripheral iron core portion 24, is moved toward the tubular part 71 of the cover part 60, whereby the iron core 41 is inserted into the tubular part 71 and the coil 51. Regarding the other iron cores 42 and 43, which are integrally formed with the other outer peripheral iron core portions 25 and 26, respectively, the exposed coils 52 and 53 and the tubular parts 72 and 73, respectively, are similarly attached at the same time and in the same manner.

As a result, the reactor 6 shown in FIG. 6A is manufactured. In this case, since the exposed coils 51 to 53 are insulated by the cover part 60, the same effects as described above can be obtained. Further, when the cover part 60 is used, it is possible to reduce the number of parts, whereby the cover part 60 can be attached to the iron cores 41 to 43 more easily.

Figure 8:
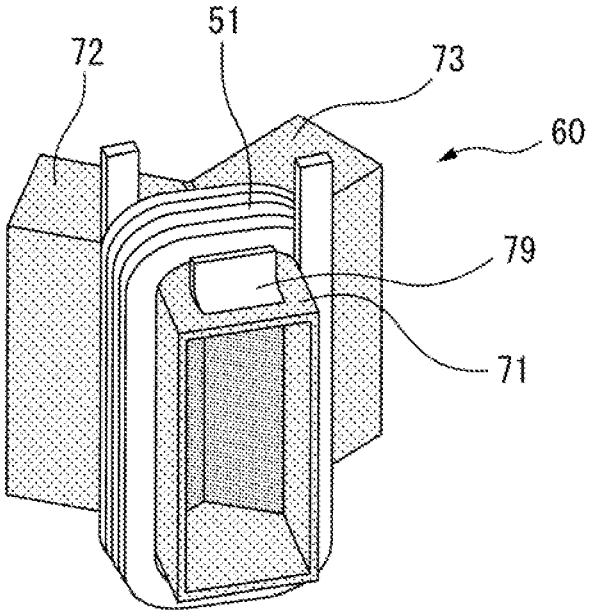
FIG. 8 is a perspective view of a cover part used in a reactor according to a fifth embodiment.

Further, FIG. 8 is a perspective view of a cover part used in the reactor according to the fifth embodiment. A protrusion 79 is provided on the upper surface of the tubular part 71 of the cover part 60 shown in FIG. 8 at a position more radially outside than the coil 51. The height of the protrusion 79 is preferably smaller than the thickness of the coil 51.

Such a protrusion 79 is preferably attached after the coil 51 has been attached to the tubular part 71. The protrusion 79 may be attached to the lower surface of the tubular part 71 or protrusions 79 may be attached to both the upper and lower surfaces of the tubular part 71. Though not shown in the drawing, protrusions 79 are also attached to the other tubular parts 72 and 73 in the same manner. When such protrusions 79 are attached, the coils 51 to 53 can be fixed at their attachment positions. Thus, after assembling the reactor 6, it is possible to prevent contact between the coils 51 to 53 and the outer peripheral iron core portions 24 to 26.

Figure 9:
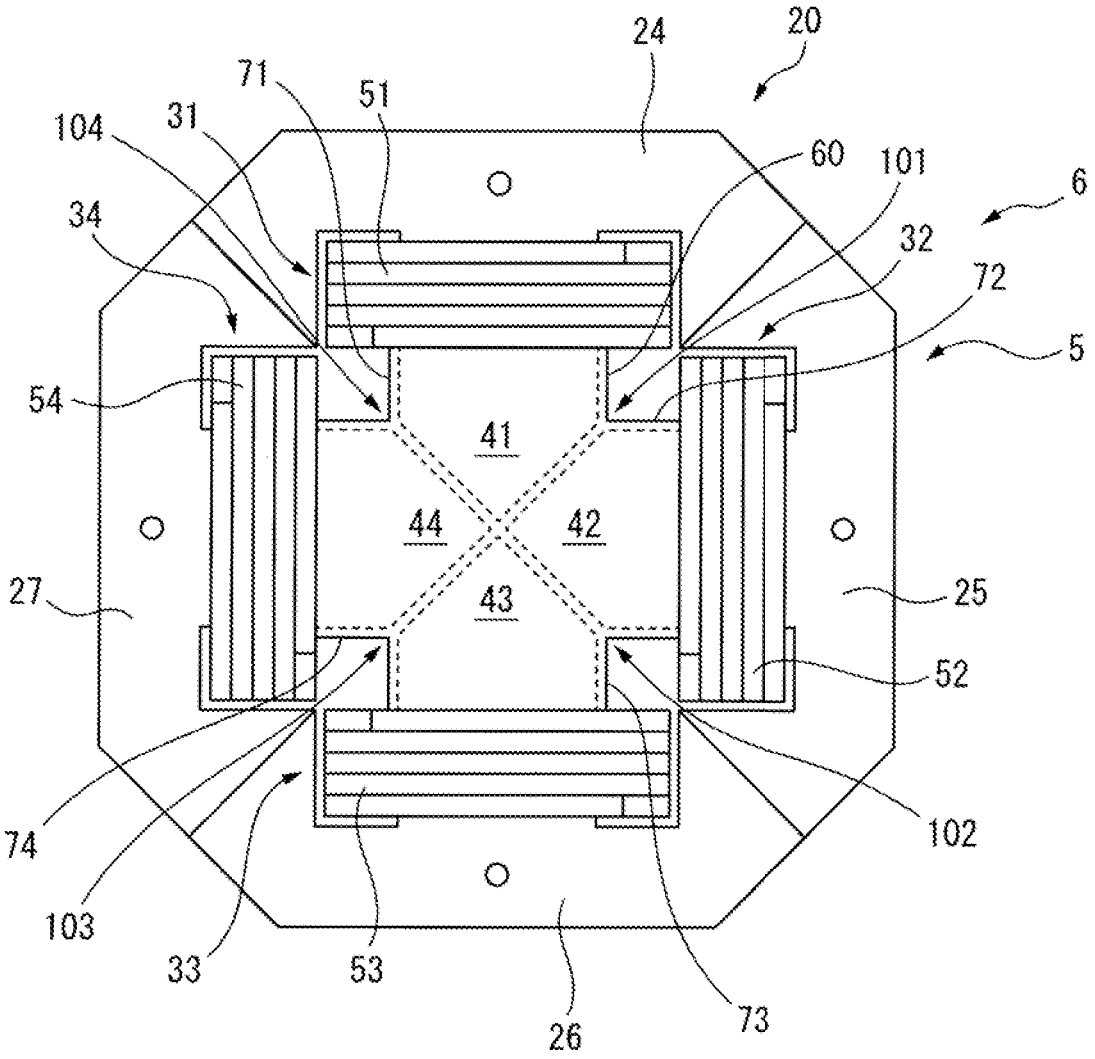
FIG. 9 is an end view of a reactor according to a sixth embodiment.

Further, FIG. 9 is an end view of the reactor according to the fifth embodiment. FIG. 9 is the same as FIG. 5. In FIG. 9, an approximately X-shaped cover part 60 including four tubular parts 71 to 74 is attached to the iron cores 41 to 44. In this case, it is clear that the reactor 6 can be manufactured in the same manner as described above, and thus, the same effects as described above can be obtained.

Aspects of the Present Disclosure

According to the first aspect, there is provided a reactor (6) comprising a core body (5), the core body comprising an outer peripheral iron core (20) composed of a plurality of outer peripheral iron core portions (24 to 27), at least three iron cores (41 to 44) coupled to the plurality of outer peripheral iron core portions, and coils (51 to 54) wound onto the at least three iron cores, wherein gaps (101 to 104), which can be magnetically coupled, are formed between one of the at least three iron cores and another iron core adjacent thereto, the reactor further comprising cover parts (60 and 61 to 64) which at least partially cover the iron cores and provide insulation from the coils.

According to the second aspect, in the first aspect, further comprising additional cover parts (61*a* to 64*b*) which at least partially cover the inner surfaces of the outer peripheral iron core portions and provide insulation from the coils.

According to the third aspect, in the first or second aspect, the cover parts include projecting portions (61*c* to 64*c*) which project from end surfaces of the iron cores.

According to the fourth aspect, the cover parts are made of a single member that at least partially covers the at least three iron cores and provides insulation from the coils corresponding to the at least three iron cores.

According to the fifth aspect, the cover parts include a partition which is provided at positions corresponding to the gaps.

According to the sixth aspect, protrusions (79) are provided on portions of the outer surfaces of the cover parts that are located more radially outwardly than the coils.

According to the seventh aspect, in any of the first through sixth aspects, the number of the at least three iron cores is a multiple of three.

According to the eighth aspect, in any of the first through sixth aspects, the number of the at least three iron cores is an event number not less than four.

Effects of the Aspects

In the first aspect, the coils are not housed in casings, and the coils are attached to the iron cores in an exposed state via the cover parts. Thus, when the reactor is supplied with electricity, the heat from the coils can be released to the outside, and as a result, a rise in temperature of the reactor can be prevented.

In the second aspect, it is not necessary to form clearances between the coils and the additional cover parts. Thus, the reactor can be miniaturized.

In the third aspect, it is possible to further improve the insulation between the coils and the inner surfaces of the outer peripheral iron core portions.

In the fourth aspect, since it is possible to reduce the number of components, it is easier to attach the cover parts to the iron cores.

In the fifth aspect, since the sizes of the gaps can be maintained by the partition, noise from the reactor and vibration of the reactor can be prevented.

In the sixth aspect, contact between the coils and the outer peripheral iron core portions can be prevented.

In the seventh aspect, the reactor can be used as a three-phase reactor.

In the eighth aspect, the reactor can be used as a single-phase reactor.

Though the present invention has been described using representative embodiments, a person skilled in the art would understand that the foregoing modifications and various other modifications, omissions, and additions can be made without departing from the scope of the present invention. Furthermore, appropriate combinations of some of the embodiments described above is within the scope of the present disclosure.

The invention claimed is:

1. A reactor, comprising:

a core body, the core body comprising:

an outer peripheral iron core composed of a plurality of outer peripheral iron core portions, at least three iron cores coupled to the plurality of outer peripheral iron core portions, and coils wound onto the at least three iron cores; wherein gaps, which can be magnetically coupled, are formed between one of the at least three iron cores and another iron core adjacent thereto, wherein a point of intersection of the gaps is located at a center of the core body; the reactor further comprising:

cover parts which at least partially cover the iron cores and provide insulation from the coils, wherein the cover parts are arranged between the outer peripheral iron core portions and the coils, and additional cover parts which at least partially cover the inner surfaces of the outer peripheral iron core portions and provide insulation from the coils, the additional cover parts having shapes corresponding to an inner surface of the outer peripheral iron core, wherein the additional cover parts are attached to an edge portion of the side surfaces of the cover parts.

2. The reactor according to claim 1, wherein the cover parts include projecting portions which project from end surfaces of the iron cores.

3. The reactor according to claim 1, wherein protrusions are provided on portions of the outer surfaces of the cover parts that are located more radially outwardly than the coils.

4. The reactor according to claim 1, wherein the number of the at least three iron cores is a multiple of three.

5. The reactor according to claim 1, wherein the number of the at least three iron cores is an even number not less than 4.

6. The reactor according to claim 1, wherein the cover parts are made of a single member.

* * * * *